US005366080A

United States Patent [19]

Carstersen et al.

[11] Patent Number: 5,366,080

[45] Date of Patent: Nov. 22, 1994

[54] MOLDED RIDGE TOLERANCE COMPENSATOR

[75] Inventors: Ronald T. Carstersen, Santa Cruz; William R. Phillips, Soquel, both of Calif.

[73] Assignee: Seagate Technology, Inc., Scotts Valley, Calif.

[21] Appl. No.: 140,741

[22] Filed: Oct. 21, 1993

[51] Int. Cl.[5] ..... B65D 81/02; B65D 85/30

[52] U.S. Cl. ..... 206/334; 206/523; 206/589

[58] Field of Search ..... 206/334, 523, 587, 588, 206/589, 591, 592, 594

[56] References Cited

U.S. PATENT DOCUMENTS

| | | | |
|---|---|---|---|
| 4,231,901 | 11/1980 | Berbeco | 206/523 X |
| 4,549,656 | 10/1985 | Barnes et al. | 206/589 |
| 4,828,115 | 5/1989 | Wiegand et al. | 206/523 X |
| 5,007,539 | 4/1991 | Ruter | 206/592 X |
| 5,127,526 | 7/1992 | Vigue | 206/523 X |
| 5,259,508 | 11/1993 | Beckerman | 206/587 |

*Primary Examiner*—Paul T. Sewell
*Assistant Examiner*—Jacob K. Ackun, Jr.
*Attorney, Agent, or Firm*—Flehr, Hohbach, Test, Albritton & Herbert

[57] ABSTRACT

A molded ridge tolerance compensator for use in a disc drive shipping apparatus comprising opposing first and second molded anti-static holding members having a plurality of receptacles recessed in a first face of each member, each of the receptacles including molded ridges for receiving, fixably maintaining and protecting a plurality of disc drives in a container. The first and second molded anti-static holding members each having four sides with a centrally located T-shaped cushion pad having smooth first facing sides extending from each side for conforming to the interior of a container for shipment. The union of each side is formed by a pair of inverted L-shaped cushion pads joined at the top and whose junction is chamfered for ease of insertion and removal from a container. The first and second molded anti-static holding members further each having a first end opposing the first face, the first end having a plurality of tapered conical cushion pads symmetrically extending from the first end for assuring shock protection for the disc drive devices enclosed within the first and second molded anti-static holding members.

17 Claims, 10 Drawing Sheets

MOLDED RIDGE TOLERANCE COMPENSATOR

The present invention relates generally to packaging materials. More particularly, the invention relates to a holding apparatus implemented by means of first and second molded anti-static holding members having a plurality of receptacles recessed in each member, including molded ridges for receiving, fixably maintaining and protecting a plurality of disc drives in a container.

BACKGROUND OF THE INVENTION

The present invention provides an improvement in the packaging of hard disc drives for computer systems. Computer hard disc drives are often produced by manufacturers for sale to original equipment manufactures (OEMs) or for shipment to computer resellers. As is for most items, the physical characteristics of the item to be shipped play a significant role in the shipping costs that will be incurred. As such most manufacturers attempt to minimize the physical size, weight, and numerosity of items to be shipped.

Disc drives are generally shipped in large shipping containers containing multiple units, so as to minimize costs. In packaging these computer disc drives, care must be taken to prevent the drives from being damaged enroute. Specifically, the drives must be protected from shock and electro-static discharge (ESD).

Computer disc drives are known to be sensitive to ESD, necessitating the isolation of the disc drives from static generating sources. In the prior art, each individual disc drive was placed in a specially produced ESD resistant baggie with the appropriate warning labels affixed. The baggies represent a practical form of protection, providing a measure of isolation of the disc drive from external ESD sources. While this represents a safe method of shipping the devices, the individual wrapping time, and added space and weight to the shipment reduces the overall profitability of each device.

Additionally, in shipments to OEMs and computer vendors who are well versed in ESD protection, the individual wrapping causes more burden than protection. This is because the OEMs and computer vendors, along with original manufacturers, practice other better forms of protection such as utilizing grounding methods, static guards (leg-stats and wrist-stats), and humidity controlled environments in order to protect the devices. As such, the need for individual wrapping arises from the shipment alone. While baggies satisfy these shipping protection requirements, the industry ships voluminous amounts of ESD sensitive devices, and as such would benefit from any improvement in the protection methodologies presently known.

Similarly, the computer disc drives must be protected from the sometimes harsh shipping environments in order to assure product fidelity upon delivery. Shocks, in the form of drops and knocks are well known in the shipping industry at levels from 600 to 800 Gs for shipping containers. A measure of a packaging materials performance can be assessed by the materials ability to dissipate shock, and is often measured by performing shock tests. Shock tests simulate shipping environments. By a process of repeatedly dropping the packaged devices from heights up to 48 inches the performance of the packaging material can be measured. Because shock levels at or above 90 Gs represent those kinds of knocks and drops found to damage disc drives, performance is based on a packaging material's ability to repeatedly dissipate shocks to a level less than 90 Gs.

In the prior art, packaging material constructed from expanded polystyrene has been commonly employed to be utilized in the shipment of disc drives. Expanded polystyrene packaging has heretofore been desirable because of its light weight, low cost and molding characteristics which allow the production of molded cutouts to form fit to individual devices within a tolerance of $\pm 1$ mm. However, expanded polystyrene packaging materials tend to shatter and permanently deform upon shock, thereby providing limited capability to protect devices from normal shipping shocks in excess of 90 Gs. Because repeated shocks in excess of 90 Gs are representative of those knocks and drops often found in commercial shipping environments, the use of expanded polystyrene is inadequate to realistically protect the enclosed devices. Additionally, while expandable polystyrene is recyclable, it is not reusable, and as such represents an environmental concern.

SUMMARY OF THE INVENTION

To overcome the limitations of the prior art, it is an object of the present invention to provide an improved apparatus for shipping a disc drive assembly capable of fixably maintaining a plurality of disc drives in a container.

It is a further object of the present invention to provide an improved disc drive protection apparatus capable of repeatedly dissipating shock levels to less than 90 Gs while maintaining a plurality of disc drives in a container.

It is a further object of the present invention to provide an improved disc drive protection apparatus capable of protecting a plurality of disc drives from electrostatic discharges while in transit in a container.

It is a further object of the present invention to provide an improved disc drive protection apparatus having a plurality of receptacles with molded ridges for receiving a like plurality of disc drives in which the molded ridges act as tolerance compensators for fixably maintaining the plurality of disc drives in a container.

Finally, it is an object of the present invention to provide an improved disc drive shipping apparatus that is reusable and capable of being recycled for producing another similar disc drive shipping apparatus upon wearing out.

The apparatus of the present invention comprises opposing first and second molded anti-static holding members having a plurality of receptacles recessed in a first face of each member, each of the receptacles including molded tolerance compensation ridges for receiving, fixably maintaining and protecting a plurality of disc drives in a container. The first and second molded anti-static holding members each having four sides with a centrally located T-shaped cushion pad having smooth first facing sides extending from each side for conforming to the interior of a container for shipment. The union of each side is formed by a pair of inverted L-shaped cushion pads joined at the top and whose junction is chamfered for ease of insertion and removal from a container. The first and second molded anti-static holding members further each having a first end opposing the first face, the first end having a plurality of tapered conical cushion pads symmetrically extending from the first end. The plurality of cushion pads assure shock protection for the disc drive devices enclosed within the first and second molded anti-static holding members.

BRIEF DESCRIPTION OF THE DRAWINGS

Additional objects and features of the invention will be more readily apparent from the following detailed description and appended claims when taken in conjunction with the drawings, in which:

DESCRIPTION OF THE PREFERRED EMBODIMENT

Figure 1:
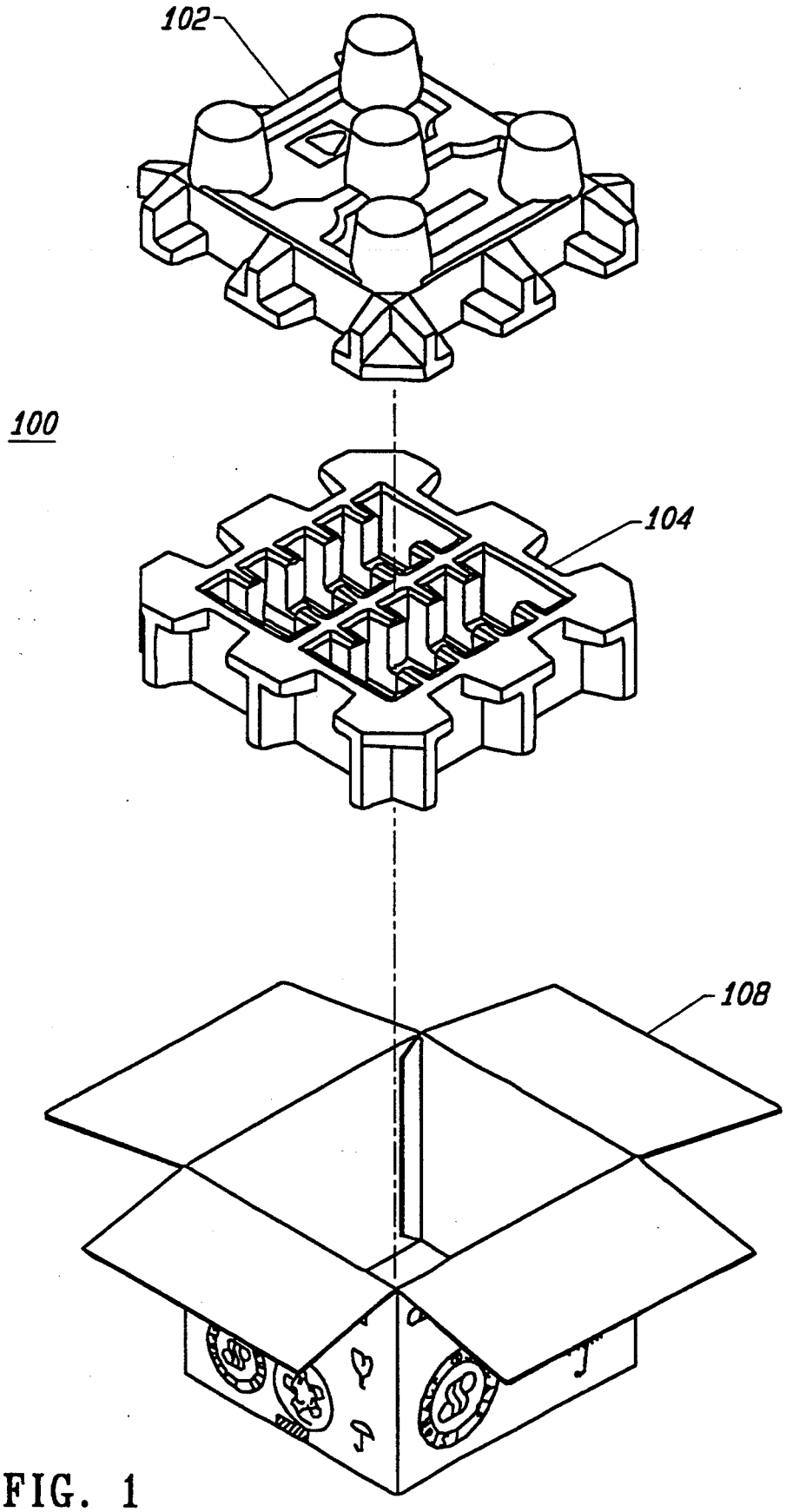
FIG. 1 is a isometric view of the preferred embodiment of the present invention.

Referring first to FIG. 1, an improved disc drive shipping apparatus 100 is shown comprising a first 102 and second holding member 104 for supporting and maintaining a plurality of disc drives 106. The improved disc drive apparatus 100 is sized to conform to the interior of a shipping container 108.

Figure 2:
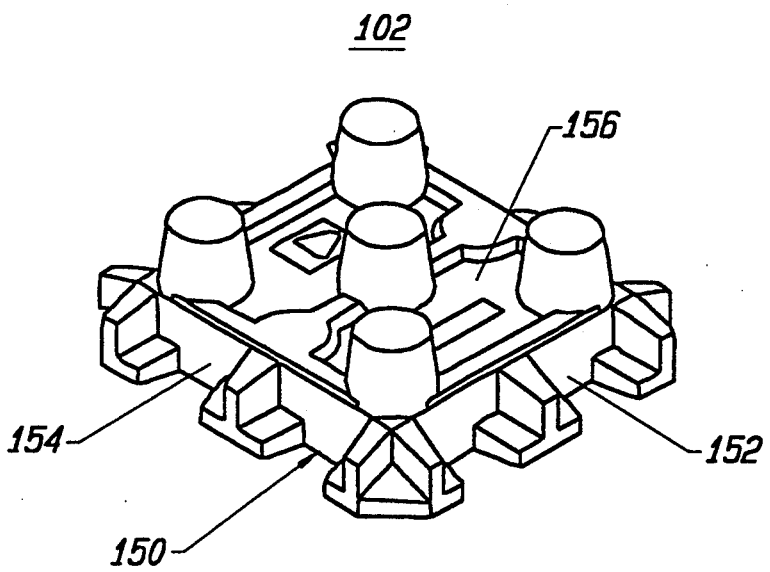
FIG. 2 is a view of the first holding member of the preferred embodiment of the present invention.

FIG. 2 shows the first holding member 102 for receiving a plurality of disc drives 106 (not shown). The first holding member 102 comprises a first face 150, a first 152 and second pair of opposing side(s) 154 and a first end 156.

Figure 3B:
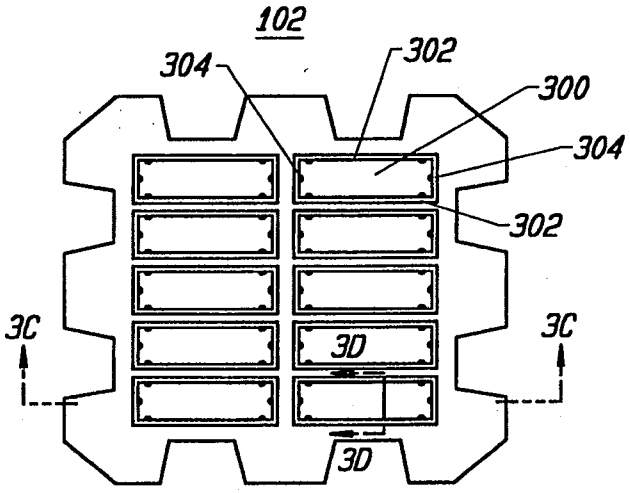
FIG. 3*b* is a view of a receptacle recessed in a first face of the first holding member of the preferred embodiment of the present invention.
Figure 3D:
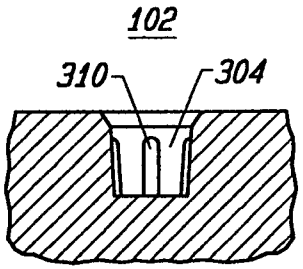
FIG. 3*d* is a cross-sectional view along the B—B axis of a receptacle recessed in a first face of the first holding member of the preferred embodiment of the present invention.
Figure 3A:
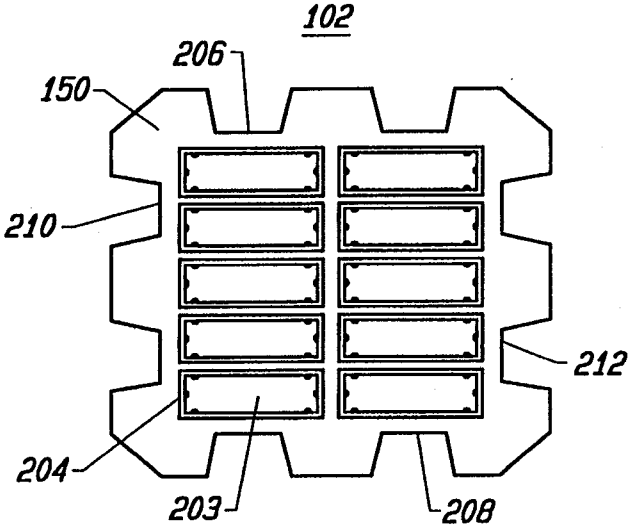
FIG. 3*a* is a front view of first face of the first holding member of the preferred embodiment of the present invention.

The first face 150 having a plurality of rectangular receptacles 203 is shown in FIG. 3*a*. In the preferred embodiment of the present invention ten rectangular receptacles 203 are molded into the first face 150 of the first holding member 102. In the preferred embodiment, the rectangular receptacles 203 are each 25 mm in depth and 73 mm in length by 20 mm in width (inside dimension) at their base, and 75 mm by 23 mm (inside dimension below bevel) at their top with a beveled upper edge 204 cut at an angle of 45 degrees starting 4 mm below the intersection of the receptacle 203 and the first face 150 respectively. In this configuration the receptacles are capable of receiving a disc drive 106 with dimensions of 70 mm in length by 19 mm in width and of a variable height. Those ordinarily skilled in the art will recognize that the particular dimensions chosen are not significant, and should not be construed as limiting. Rather, the inventive aspect of the invention lies in the relationship of the interior dimensions of the rectangular receptacle in conjunction with the dimensions of the device being shipped. The ten receptacles 203 are spaced in two columns of five receptacles each, separated by 5 mm between the columns and 2 mm between respective rectangular receptacles in any column. In the preferred embodiment, the columns are located 7.5 mm from the top 206 and bottom edge 208 of the first face 150, and 8 mm from the left 210 and right edge 212 of the first face 150, thereby centrally locating the receptacles in the first holding member 102.

Each holding member is formed by molding as is known in the art. In the preferred embodiment of the present invention an expanded polyethylene foam (polyolefin) is utilized with an anti-static filler manufactured by E.P.E., Inc. for protecting the devices from static discharges. The polyolefin foam is recyclable and reusable and as such may be ground and reshot into another product after use. One limitation of the polyolefin is the larger molding tolerance, typically ±2 mm.

The shipping molds of the prior art relied on expanded polystyrene materials to be molded to very tight tolerances to snugly form fit each device in its respective shipping container. The relatively small mass of the typical molded holding members of the prior art necessitated a snug fit to hold the disc drives which were obviously of a much greater proportionate mass. A loose fit would allow the larger mass disc drives freedom to move, thereby resulting in the crushing of the inside of smaller mass holding members as the disc drives were shifted from side to side (or up and down). In this configuration, a disc drive which is loosely held experiences two distinct collisions in response to a given shock; a first collision as the exterior surface of the holding member strikes (or is struck) by a physical obstruction, and a second collision as the disc drive within the holding member strikes the inside of the holding member.

This "interior collision" is magnified as continued movement occurs due to the increased freedom that the disc drive experiences after each succeeding movement (the farther the disc drive travels, the more momentum is developed and, necessarily, the greater the interior crushing that will occur). However, when the disc drives are snugly held by a holding member, the disc drive and holding member will move as a single body. Upon a shock, the exterior surface of the holding member absorbs the full impact, and no secondary collision occurs between the item being protected and the holding member, thereby affording greater protection to the device being shipped.

The expanded polyolefin material has a lower molding tolerance than prior art polystyrene foam materials, and as noted above are only capable of achieving molds with tolerances of ±2 mm in each direction. As such, a snug fit between a disc drive and a receptacle in a mold formed from an expanded polyolefin material would not ordinarily be achievable. Herein lies a particular advantage of the present invention.

Figure 3C:
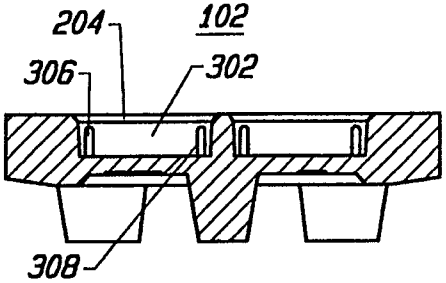
FIG. 3*c* is a cross-sectional view along the A—A axis of a receptacle recessed in a first face of the first holding member of the preferred embodiment of the present invention.

Referring now to FIG. 3*b*, each receptacle 203 comprises a bottom face 300, a first pair of opposing walls 302 and a second pair of opposing walls 304. The opposing walls form the side boundaries of the receptacle between the first face 150 and the bottom face 300 of each receptacle 203. Extending from each wall of the first pair of opposing walls 302 is a first 306 and second molded tolerance compensation ridge 308 as can be seen on FIG. 3*c*. In the preferred embodiment of the present invention, the first 306 and second tolerance compensation ridge(s) 308 are finger shaped half circular protrusions of diameter 2 mm and length 17 mm with a spherical top. The first 306 and second tolerance compensation ridge(s) 308 lie on the surface of the first pair of opposing walls 302 and extend from the bottom face 300 along a line perpendicular to the bottom face 300 toward the first face 150 of the first holding member 102. The first 306 and second molded tolerance compensation ridge(s) 308 are further positioned centered at a point 4.5 mm from each edge of the first pair of opposing walls 302, thereby spread 64 mm apart center to center (at their respective bases).

Referring now to FIG. 3*d*, extending from each wall of the second pair of opposing walls 304 is a third molded tolerance compensation ridge 310. In the preferred embodiment of the present invention, the third tolerance compensation ridge 310 is a finger shaped half circular protrusion of diameter 2 mm and length 17 mm with a spherical top. The third tolerance compensation ridge 310 lies on the surface of the second pair of opposing walls 304 and extends from the bottom face 300 along a line perpendicular to the bottom face 300 toward the first face 150 of the first holding member 102. The third molded tolerance compensation ridge 310 is further positioned centered at a point 10 mm from each edge of the second pair of opposing walls 304. In summary, in the preferred embodiment three ridge are provided, symmetrically disposed at opposite ends of each receptacle.

The six molded tolerance compensators 306, 308 and 310 (two on each of the first pair of opposing walls and one on each of the second pair of opposing walls) provide the form fit that might ordinarily be lacking due to the unusually high molding tolerance of ±2 mm for the expanded polyolefin material. For example, when the first holding member 102 is molded as has been described above with dimensions exactly designed to receive a disc drive 106 (70 mm by 19 mm by N mm (height)), a tolerance of ±2 mm may result in a rectangular receptacle that is undersized or oversized. As the first holding member 102 receives a disc drive 106 for insertion into one of the rectangular receptacles 203, the disc drive 106 will come into contact with each ridge, at which time assuming the disc drive is centered over the rectangular receptacle, one of three events will occur: 1) if the rectangular receptacle is undersized (having a minimum dimension of 71 mm by 19 mm at the bottom of the receptacle and 73 mm by 21 mm at the opening), the tapered and beveled opening to the rectangular receptacle will receive the disc drive, at which time the larger mass disc drive will crush the molded ridge compensators, making room for the disc drive in the receptacle, thereby fixably and snugly maintaining the device in the holding member; or, 2) if the rectangular receptacle is oversized (having a maximum dimension of 75 mm by 22 mm at the bottom of the receptacle and 77 mm by 25 mm at the opening), the tapered and beveled opening to the rectangular receptacle will receive the disc drive, at which time the molded ridge compensators will come into contact with the device at least two points along the disc drive device (this is because each of the molded ridge compensators extend 2 mm further into the opening defined by the inside walls of the receptacle, thereby forming a "secondary" inside dimension of 71 mm by 18 mm, thereby fixably and snugly maintaining the device in the holding member by means of the molded ridge tolerance compensators); or, 3) if the rectangular receptacle is some where in between these extremes (oversized to undersized), the molded tolerance compensation ridges will be partially crushed fixably supporting and maintaining the disc drive 106 in the first holding member 102.

One advantage of the present invention lies in the selection of materials. The expanded polyethylene material selected will regain its shape after experiencing the crushing described above. In the preferred embodiment of the present invention, testing revealed that all of the crushable ribs which were subjected to compression upon insertion of a disc drive regained their original shape within 24 hours after removal of the disc drive. As such, each holding member was able to be successfully reused for a subsequent shipping operation.

Figure 4:
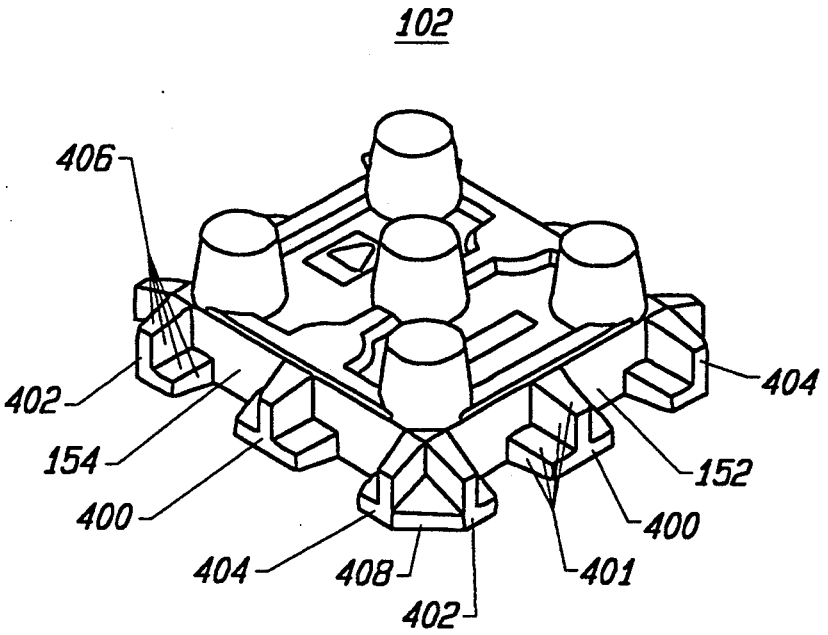
FIG. 4 is a view of the first and second adjacent sides of the first holding member of the preferred embodiment of the present invention.

Referring now to FIG. 4, the first 152 and second pair of opposing side(s) 154 of the first holding member 102 are shown. In the preferred embodiment each side is rectangular in shape with dimensions of 187 mm by 42 mm for the first pair of opposing sides and a dimension of 178 mm by 42 mm for the second pair of opposing sides. Each side 152 and 154 includes a centrally disposed raised T-shape cushion pad 400 whose head (top of the "T") intersects and forms an edge with the first face 150 of the first holding member 102. In the preferred embodiment of the present invention, the raised T-shaped cushion pad 400 has dimensions of 40 mm by 10 mm (top) and 27 mm by 10 mm (body), is raised 28 mm from the surface of the each side 152 and 154 and has beveled side faces 401 which extend the dimensions at the base of the T-shaped cushion pad 400 at the surface of the side 152 and 154 to 60 mm by 15 mm (top) and 27 mm by 20 mm (body).

The sides 152 and 154 also include a first 402 and second opposing inverted L-shaped end cushion pad(s) 404 whose dimensions are similar to the T-shaped cushion pad 400 [25 mm by 10 mm (top) and 27 mm by 10 mm (body)] and which is similarly raised 28 mm from the surface of the side 201. The first 402 and second opposing inverted L-shaped end cushion pads also include beveled edges 406 which extend the dimensions at the base of the inverted L-shaped end cushion pad at the surface of the sides 152 and 154 to 30 mm by 15 mm (top) and 27 mm by 15 mm (body). Each inverted L-shaped end cushion pad is joined to its adjacent opposing inverted L-shaped end cushion pad located on a intersecting side by means of a triangular wedge 408.

The triangular wedge 408 joins the adjacent inverted L-shaped end cushion pads at the top portion, and is of similar dimensions to the top of the respective inverted L-shaped end cushion pad. Those ordinarily skilled in the art will recognize that the T-shaped and L-shaped cushion pads located around the first holding member 102 act to protect the devices held by the apparatus 100 from shocks received by each side.

Figure 5:
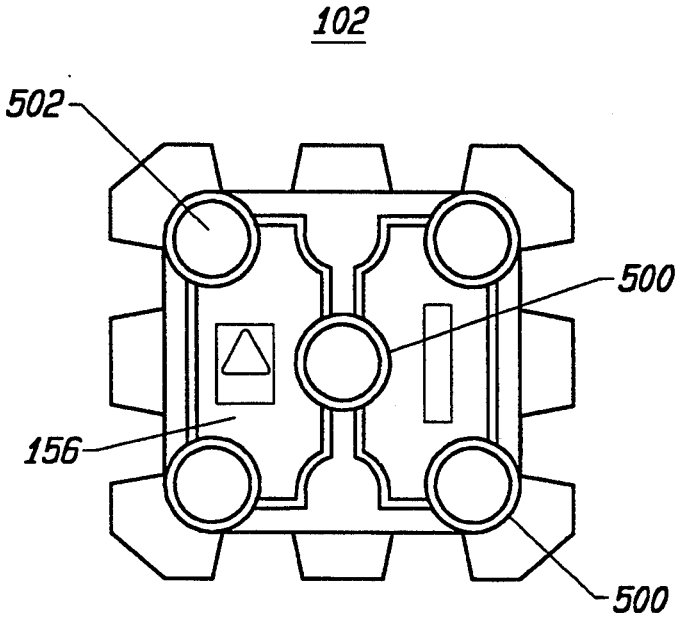
FIG. 5 is a view of the first end of the first holding member of the preferred embodiment of the present invention.

Referring to FIG. 5, the first end 156 having a plurality of tapered conical cushion pads 500 is shown. The tapered conical cushion pads 500 extend symmetrically from the first end 156 for assuring shock protection for the disc drive devices 106 enclosed within the first 102 and second molded anti-static holding members 104. In the preferred embodiment of the present invention, the tapered conical cushion pads 500 extend 34 mm from the surface of the first end 156, having a top face 502 of circular shape and diameter 20 mm. The body of the tapered conical cushion pads 500 is sloped from the top to bottom forming a base 504 of circular shape and dimension of 25 mm in diameter. Those ordinarily skilled in the art will recognize that the tapered conical cushion pads 500 located on the first end 156 of the first holding member 102 act to protect the devices held by the apparatus 100 from shocks received along the first end 156.

Figure 6:
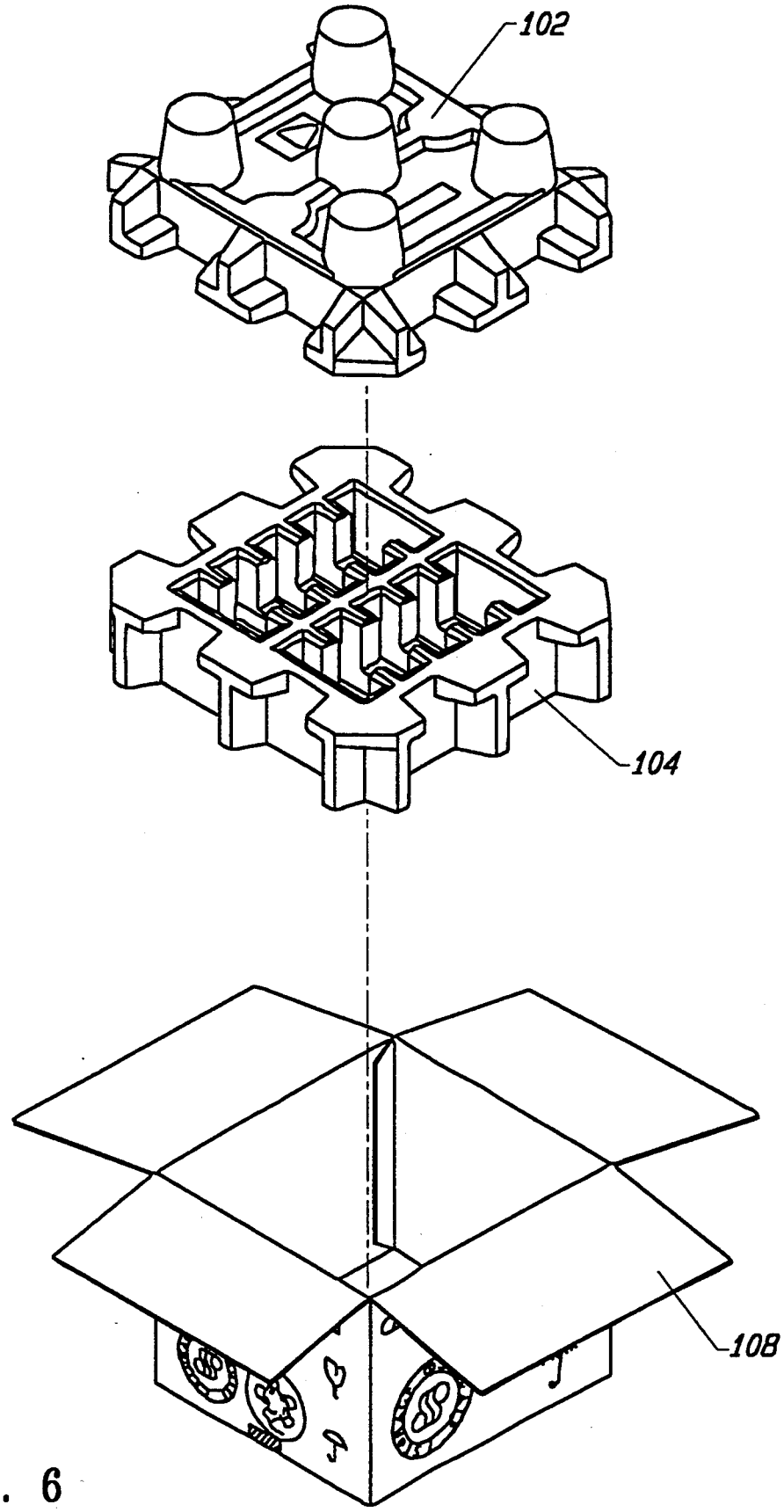
FIG. 6 is a isometric exploded view of the preferred embodiment of the present invention including a second holding member.

Referring to FIG. 6, the preferred embodiment of the present invention is shown including the second holding member 104. The second holding member is substantially similar to the first holding member 102, with the minor dimensional changes noted below. The second holding member 102 is utilized to receive a second end of the disc drive 106, thereby encompassing the disc drive between the first 102 and second 104 holding member(s) 104. In the preferred embodiment of the present invention, upon positioning the disc drive 106 within the first 102 and second holding member(s), a gap of up to 25% of the length of the overall encapsulation may exist between the holding members. Those ordinarily skilled in the art will recognize that the gap allows for a cost savings on material, while maintaining product integrity because of the unique support mechanism formed by the union of the first 102 and second holding member(s) 104 about the disc drive 106.

Figure 7:
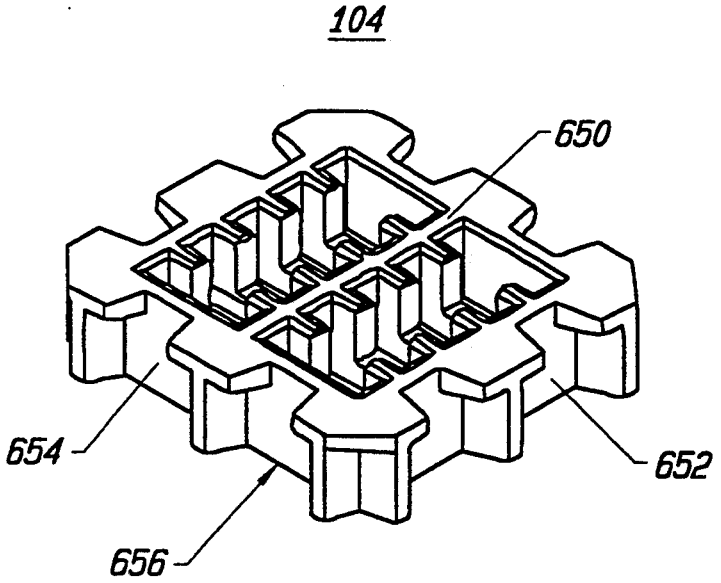
FIG. 7 is a view of the second holding member of the preferred embodiment of the present invention.

The second holding member 104 is shown in FIG. 7, comprising a first face 650, a first 652 and second pair of opposing side(s) 654 and a first end 656. The first face 650 includes a plurality of rectangular receptacles 703 as is shown in FIG. 8*a*. In the preferred embodiment of the present invention ten rectangular receptacles 703 are molded into the first face 700 of the second holding member 104. In the preferred embodiment, the rectangular receptacles 703 are each 50 mm in depth and 71.5 mm in length and 19.5 mm in width (inside dimension) at their base and 72 mm by 21.5 mm (inside dimension) at their top with a beveled upper edge 704 cut at an angle of 45 degrees starting 4 mm below the intersection of the receptacle 703 and the first face 650 respectively. In this configuration the receptacles are capable of receiving a disc drive 106 with dimensions of 70 mm in length by 19 mm in width and of a variable height. Those ordinarily skilled in the art will recognize that the particular dimensions chosen are not significant, and should not be construed as limiting. Rather, the inventive aspect of the invention lies in the relationship of the interior dimensions of the rectangular receptacle in conjunction with the dimensions of the device being shipped. The ten receptacles 703 are spaced in two columns of five receptacles each, separated by 8 mm between the columns and 3.5 mm between respective rectangular receptacles in any column. In the preferred embodiment, the columns are located 8.25 mm from the top 706 and bottom edge 708 of the first face 700, and 10 mm from the left 710 and right edge 712 of the first face 700 thereby centrally locating the receptacles in the second holding member 104.

Figure 8B:
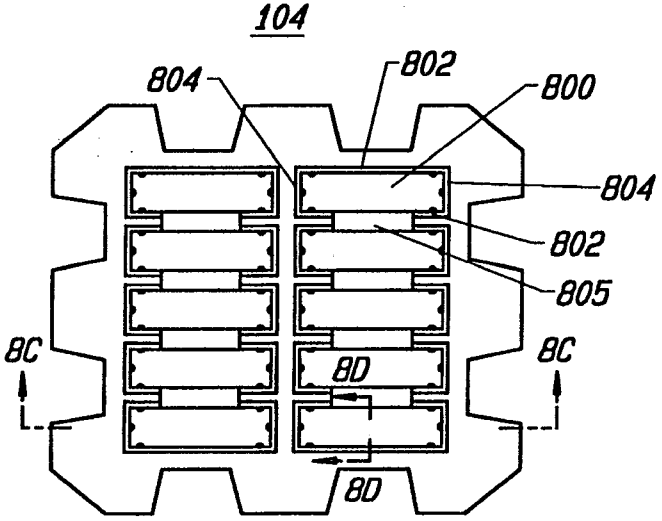
FIG. 8*b* is a view of a receptacle recessed in a first face of the second holding member of the preferred embodiment of the present invention.
Figure 8A:
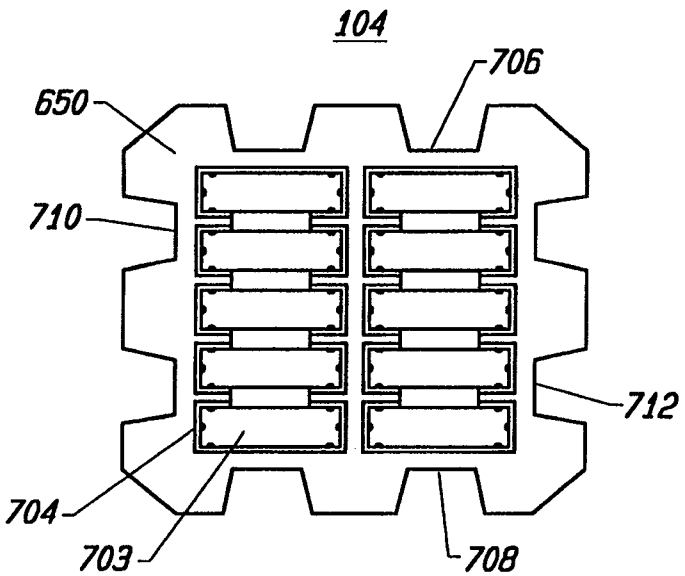
FIG. 8*a* is a front view of first face of the second holding member of the preferred embodiment of the present invention.

Referring now to FIG. 8*b*, each receptacle 703 comprises a bottom face 800, a first pair of opposing walls 802 and a second pair of opposing walls 804. The opposing walls form the side boundaries of the receptacle between the first face 650 and the bottom face 800 of each receptacle 703. In the preferred embodiment of the present invention, each interior wall (8 total) formed by the stacked receptacles having opposing first pair of walls 802, includes a single U-shaped cut-out 805 of 35 mm in depth and 40 mm in length at the base which is tapered to 50 mm at the top of the U-shaped cut-out 805. Extending from each wall of the first pair of opposing walls 802 is a first 806 and second molded tolerance compensation ridge 808 as is shown in FIG. 8*c*. In the preferred embodiment of the present invention, the first 806 and second tolerance compensation ridge(s) 808 are finger shaped, slightly tapered from the bottom to the top, half circular protrusions of diameter 2 mm and length 40 mm. The first 806 and second tolerance compensation ridge(s) 808 lies on the surface of the first pair of opposing walls 802 and extends from the bottom face 800 along a line perpendicular to the bottom face 800 toward the first face 650 of the second holding member 104. The first 806 and second molded tolerance compensation ridge(s) 808 are further positioned centered at a point 3.5 mm from each edge of the first pair of opposing walls 802 (at their base), thereby spread 64 mm apart center to center.

Figure 8D:
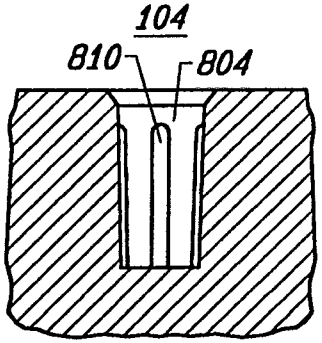
FIG. 8*d* is a cross-sectional view along the B—B axis of a receptacle recessed in a first face of the second holding member of the preferred embodiment of the present invention.
Figure 8C:
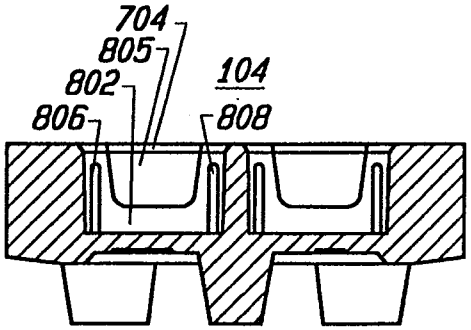
FIG. 8*c* is a cross-sectional view along the A—A axis of a receptacle recessed in a first face of the second holding member of the preferred embodiment of the present invention.

Referring now to FIG. 8*d*, extending from each wall of the second pair of opposing walls 804 is a third molded tolerance compensation ridge 810. In the preferred embodiment of the present invention, the third tolerance compensation ridge 810 is a finger shaped, slightly tapered from the bottom to the top, half circular protrusion of diameter 2 mm and length 40 mm. The third tolerance compensation ridge 810 lies on the surface of the second pair of opposing walls 804 and extends from the bottom face 800 along a line perpendicular to the bottom face 800 toward the first face 650 of the second holding member 104. The third molded tolerance compensation ridge 810 is further positioned centered at a point 9.75 mm from each base edge of the second pair of opposing walls 804. The six molded tolerance compensators 806 and 808 (two on each of the first pair of opposing walls and one on each of the second pair of opposing walls) provide the form fit that might ordinarily be lacking due to the unusually high molding tolerance of ±2 mm for the expanded polyolefin material.

The six molded tolerance compensators 806, 808 and 810 (two on each of the first pair of opposing walls and one on each of the second pair of opposing walls) provide the form fit that might ordinarily be lacking due to the unusually high molding tolerance of ±2 mm for the expanded polyolefin material. For example, when the first holding member 102 is molded as has been described above with dimensions exactly designed to receive a disc drive 106 (70 mm by 19 mm by N mm (height)), a tolerance of ±2 mm may result in a rectangular receptacle that is undersized or oversized. As the second holding member 104 receives a disc drive 106 for insertion into one of the rectangular receptacles 203, the disc drive 106 will come into contact with each ridge, at which time assuming the disc drive is centered over the rectangular receptacle, one of three events will occur: 1) if the rectangular receptacle is undersized (having a minimum dimension of 69.5 mm by 17.5 mm at the bottom of the receptacle and 70 mm by 19.5 mm at the opening), the tapered and beveled opening to the rectangular receptacle will receive the disc drive, at which time the larger mass disc drive will crush the molded ridge compensators, making room for the disc drive in the receptacle, thereby fixably and snugly maintaining the device in the holding member, or 2) if the rectangular receptacle is oversized (having a maximum dimension of 73.5 mm by 21.5 mm at the bottom of the receptacle and 74 mm by 23.5 mm at the opening), the tapered and beveled opening to the rectangular receptacle will receive the disc drive, at which time the molded ridge compensators will come into contact with the device at six points along the disc drive device, this is because the molded ridge compensators extend 2 mm father than the inside walls of the receptacle, thereby forming a "secondary" inside dimension of 69.5 mm by 17.5 mm at the bottom, thereby fixably and snugly maintaining the device in the holding member by means of the molded ridge tolerance compensators or 3) if the rectangular receptacle is some where in between these extremes (oversized to undersized), the molded tolerance compensation ridges will be partially crushed fixably supporting and maintaining the disc drive 106 in the first holding member 102.

Those ordinarily skilled in the art will recognize that the tighter tolerances (from top to base in the receptacles) on the second holding member 104, coupled with the looser tolerances in the first holding member 102 will allow for the easy removal of the first holding member 102 (top) upon arrival, without disturbing any of the individual disc drives 106. As such, the disc drives will be maintained in the second holding member 104 (bottom) until their individual use is required. This ease of removal feature allows for the individual removal of disc drives and realizes the minimum damage to the holding members upon arrival. Those ordinarily skilled in the art will also recognize that the selection of the expanded polyethylene foams will allow for the crushed tolerance compensation ridges to return to their original shape, thereby facilitating the reuse of the holding members in subsequent shipments. After extended use, the apparatus may eventually be recycled to form a new shipping apparatus.

Figure 9:
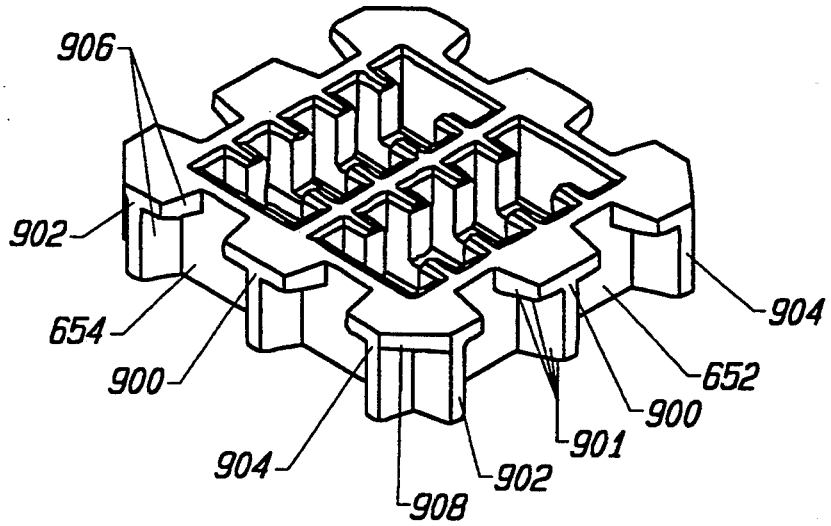
FIG. 9 is a view of the first and second opposing sides of the second holding member of the preferred embodiment of the present invention.

Referring now to FIG. 9, the first 652 and second pair of opposing side(s) 654 of the first holding member 102 are shown. In the preferred embodiment each side is rectangular in shape with dimensions of 187 mm by 67 mm for the first pair of opposing sides and a dimension of 178 mm by 67 mm for the second pair of opposing sides. Each side 652 and 654 includes a centrally disposed raised T-shape cushion pad 900 whose head (top of the "T") intersects and forms an edge with the first face 650 of the second holding member 104. In the preferred embodiment of the present invention, the raised T-shaped cushion pad 900 has dimensions of 40 mm by 10 mm (top) and 52 mm by 10 mm (body), is raised 28 mm from the surface of the each side 652 and 654 and has beveled side faces 901 which extend the dimensions at the base of the T-shaped cushion pad 900 at the surface of the side 652 and 654 to 60 mm by 15 mm (top) and 52 mm by 20 mm (body).

The sides 652 and 654 also include a first 902 and second opposing inverted L-shaped end cushion pad(s) 904 whose dimensions are similar to the T-shaped cushion pad 900 [25 mm by 10 mm (top) and 52 mm by 10 mm (body)] and which is similarly raised 28 mm from the surface of the side 201. The first 902 and second opposing inverted L-shaped end cushion pads also include beveled edges 906 which extend the dimensions at the base of the inverted L-shaped cushion pad at the surface of the sides 652 and 654 to 30 mm by 15 mm (top) and 52 mm by 15 mm (body). Each inverted L-shaped cushion pad is joined to its adjacent opposing inverted L-shaped cushion pad located on a intersecting side by means of a triangular wedge 908. The triangular wedge 908 joins the adjacent L-shaped cushion pads at the top portion, and is of similar dimensions to the top of the respective L-shaped cushion pad.

Those ordinarily skilled in the art will recognize that the T-shaped and L-shaped cushion pads located around the first holding member 102 and second holding member 104 act to protect the devices held by the apparatus 100 from shocks received in the x and y planes over a full 360 degrees. Additionally those ordinarily skilled in the art will recognize that the dimensions arrived at in the preferred embodiment are suitable for use with disc drives having a mass of approximately 0.126 kg, thereby enabling the shipping apparatus to dissipate shocks to less than 90 Gs during transit.

Figure 10:
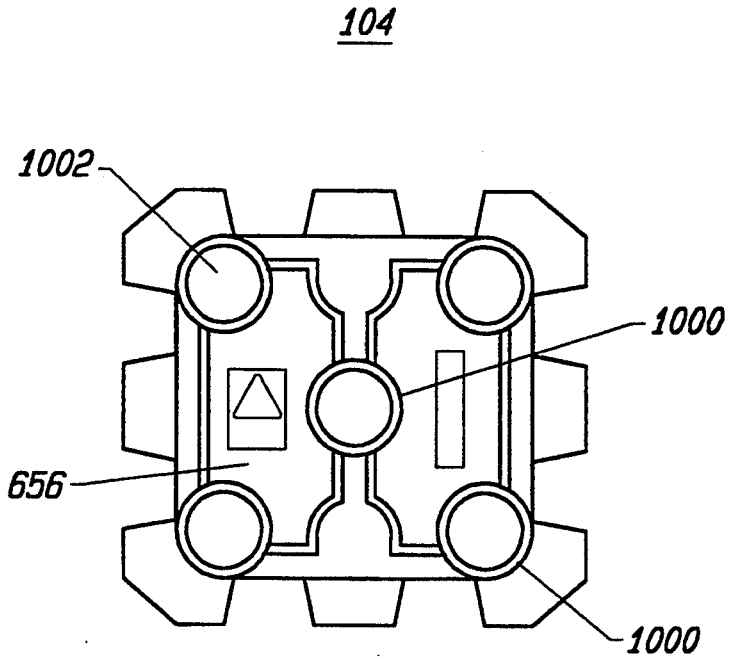
FIG. 10 is a view of the first end of the second holding member of the preferred embodiment of the present invention.

Referring to FIG. 10, the first end 656 having a plurality of tapered conical cushion pads 1000 is shown. The tapered conical cushion pads 1000 extend symmetrically from the first end 656 for assuring shock protection for the disc drive devices 106 enclosed within the first 102 and second molded anti-static holding members 104. In the preferred embodiment of the present invention, the tapered conical cushion pads 1000 extend 34 mm from the surface of the first end 656, having a top face 1002 of circular shape and diameter 20 mm. The body of the tapered conical cushion pads 1000 is sloped from the top to bottom forming a base 1004 of circular shape and dimensions of 25 mm in diameter.

Those ordinarily skilled in the art will recognize that the tapered conical cushion pads 500 and 1000 located on the first 156 and second end(s) 656 of the first 102 and second holding member(s) 104 act to protect the devices held by the apparatus 100 from shocks received in the z plane over a full 360 degrees. As such, in combination with the T-shaped cushion pads and L-shaped cushion pads on the sides 152 and 154 and 652 and 654 of the first 102 and second holding member(s) 104, the disc drives 106 are maintained within the apparatus 100 which is capable of dissipating repeated shocks to levels less than 90 Gs in any direction, thereby maintaining device integrity during transit. Additionally those ordinarily skilled in the art will recognize that the dimensions arrived at in the preferred embodiment are suitable for use with disc drives having a mass of approximately 0.126 kg, however other size cushion pads may be employed for larger devices without departing from the spirit of the present invention.

What is claimed:

1. A reusable shipping apparatus for encompassing and fixably maintaining a plurality of disc drives in a shipping container comprising:

first and second holding members, said first holding member having a first face with a plurality of receptacles including at least one crushable rib extending from at least one wall of said plurality of receptacles, said second holding member having a second face opposing said first face of said first holding member, said second face with a like plurality of receptacles including at least one crushable rib extending from at least one wall of said like plurality of receptacles, whereby upon insertion of each of said plurality of disc drives in each of said receptacles of said first and said second holding members, said crushable rib is compressed thereby fixably maintaining said each of said plurality of disc drives in an enclosure formed by said first and said second holding members.

2. The reusable shipping apparatus of claim 1 wherein said first and second holding member is a molded expanded polyethylene material.

3. The reusable shipping apparatus of claim 2 wherein said molded expanded polyethylene material includes an anti-static filler.

4. The reusable shipping apparatus of claim 1 wherein said first holding member further comprises:

an first end, said first end having a plurality of tapered conical cushion pads symmetrically positioned about said end, four sides disposed between said first end and said first face, each side comprising a centrally disposed T-shaped cushion pad and a pair of inverted L-shaped cushion pads, said T-shaped cushion pad having a top and trunk, said top flush with said first face, each of said pair of inverted L-shaped cushion pads comprising a base and a tail, said base flush with said first face, said tail flush with an adjoining side, and a plurality of wedges, each of said inverted L-shaped cushion pads connected to an adjoining L-shaped cushion pad at said base by said wedge.

5. The reusable shipping apparatus of claim 4 wherein said second holding member further comprises:

an second end, said second end having a plurality of tapered conical cushion pads symmetrically positioned about said second end, four sides disposed between said second end and said second face, each side comprising a centrally disposed T-shaped cushion pad and a pair of inverted L-shaped cushion pads, said T-shaped cushion pad having a top and trunk, said top flush with said second face, each of said pair of inverted L-shaped cushion pads comprising a base and a tail, said base flush with said second face, said tail flush with an adjoining side, and a plurality of wedges, each of said inverted L-shaped cushion pads connected to an adjoining L-shaped cushion pad at said base by said wedge.

6. The reusable shipping apparatus of claim 5 wherein said T-shaped and said pair of L-shaped cushion pads include a face, a larger base and sides, said sides tapered from said face to said larger base.

7. The reusable shipping apparatus of claim 1 wherein said second holding member is proportionately lager in height than said first holding member whereby said like plurality of receptacles in said second holding member receive a greater proportionate amount of said disc drive in each of said like plurality of receptacles than said plurality of receptacles of said first holding member.

8. The reusable shipping apparatus of claim 1 wherein said plurality of receptacles on said first and said second face include a bottom and an opening, said plurality of receptacles further having tapered walls connecting said bottom with said opening, whereby said opening is slightly larger than said bottom.

9. The reusable shipping apparatus of claim 1 wherein said plurality of receptacles on said first face of said first holding member are slightly larger than said plurality of receptacles on said second face of said second holding member, thereby allowing for ease of removal of said first holding member without disturbing said plurality of disc drives fixably maintained in said second holding member.

10. The reusable shipping apparatus of claim 1 wherein said crushable ribs regain their shape upon the removal of said each of said plurality of disc drives, thereby allowing for said first and said second holding members to be used repeatedly.

11. The reusable shipping apparatus of claim 1 wherein said plurality and like plurality of receptacles include a plurality of crushable ribs with at least one crushable rib extending from each wall.

12. The reusable shipping apparatus of claim 11 wherein said each of said receptacles includes crushable ribs correspondingly disposed in said first and said second holding members.

13. The reusable shipping apparatus of claim 11 wherein said plurality of crushable ribs are symmetrically disposed at each end of said plurality and like plurality of receptacles.

14. The reusable shipping apparatus of claim 1 wherein said enclosure formed by said first and said second holding members includes a first gap, said gap formed separating said first face of each of said first and said second holding members as said disc drives are fully seated in each of said plurality and like plurality of receptacles of said first and said second holding members.

15. The reusable shipping apparatus of claim 14 wherein said gap does not exceed 25% of the height of said disc drives contained within said enclosure.

16. A reusable shipping apparatus for encompassing and fixably maintaining a plurality of disc drives in a shipping container comprising:

first and second holding members, said first holding member having a first face and a first shell, said first face having a plurality of receptacles including at least one crushable rib extending from each wall of said plurality of receptacles, said shell having a plurality of cushion pads extending from said shell for interfacing with said shipping container, said second holding member having a second face opposing said first face of said first holding member and a second shell, said second face with a like plurality of receptacles including at least one crushable rib extending from each wall of said like plurality of receptacles, said second shell having a like plurality of cushion pads extending from said shell for interfacing with said shipping container, whereby upon insertion of each of said plurality of disc drives in each of said receptacles of said first and said second holding members, said crushable rib is compressed thereby fixably maintaining said each of said plurality of disc drives between said first and said second holding member.

17. The shipping apparatus of claim 16 wherein said first and second shell comprises four sides and a end, said end having at least five conical shaped cushion pads, and each of said four sides having at least a first T-shaped cushion pad and a pair of inverted L-shaped cushion pads, said T-shaped cushion pads centrally disposed on said each of said sides, and each of said pair of inverted L-shaped cushion pads disposed adjacent to one of said pair of inverted L-shaped cushion pads disposed on an adjoining side, said shell further comprising a plurality of wedges, said wedges for joining adjacent inverted L-shaped cushion pads on adjoining sides.

* * * * *